US005577318A

United States Patent [19]

Smith et al.

[11] Patent Number: 5,577,318

[45] Date of Patent: Nov. 26, 1996

[54] ELECTRICAL TERMINAL APPLICATOR WITH IMPROVED TRACK ADJUSTMENT MEANS

[75] Inventors: Vernon A. Smith, Naperville; Kevin J. Urness, St. Charles, both of Ill.

[73] Assignee: Molex Incorporated, Lisle, Ill.

[21] Appl. No.: 508,022

[22] Filed: Jul. 27, 1995

[51] Int. Cl.[6] ..... H01R 43/048

[52] U.S. Cl. ..... 29/753; 29/33 M; 29/863; 72/446

[58] Field of Search ..... 29/33 M, 566.2, 29/753, 863; 72/413, 441, 446

[56] References Cited

U.S. PATENT DOCUMENTS

| | | | |
|---|---|---|---|
| 3,548,479 | 12/1970 | Netta et al. | 29/753 X |
| 4,707,913 | 11/1987 | Moline | 29/753 |
| 4,805,278 | 2/1989 | Bulanda et al. | 29/753 X |
| 4,821,383 | 4/1989 | Grosklos et al. | 29/33 M |
| 4,970,889 | 11/1990 | Phillips et al. | 72/446 |
| 5,175,925 | 1/1993 | Grosklos et al. | 29/753 |
| 5,440,799 | 8/1995 | Marshall et al. | 29/753 X |

FOREIGN PATENT DOCUMENTS

| | | | |
|---|---|---|---|
| 2643514 | 8/1990 | France | 29/753 |
| 9106138 | 5/1991 | WIPO | 29/753 |

*Primary Examiner*—Peter Vo
*Attorney, Agent, or Firm*—Charles S. Cohen

[57] ABSTRACT

An electrical terminal applicator is disclosed for crimping terminals onto wires, with the terminals being secured on a strip in a side-by-side relationship. An applicator ram is drivable in a first path through a working stroke towards, and a return stroke away from, a crimping anvil. A crimping die cooperates with the anvil to crimp a portion of the terminal onto a wire during each working stroke of the ram. A track guides the strip in a second path which intersects the first path of the ram and includes a track portion mounted for adjustable movement in a direction transverse to the second path. An adjusting screw is threaded into a transverse hole in the movable track portion for adjusting the position of the track portion in the direction transverse to the second path. A locking set screw is threaded into the transverse hole for jamming against an end of the adjusting screw to lock the adjusting screw and, thus, the track portion in any position of adjustment.

16 Claims, 3 Drawing Sheets

ELECTRICAL TERMINAL APPLICATOR WITH IMPROVED TRACK ADJUSTMENT MEANS

FIELD OF THE INVENTION

This invention generally relates to the art of electrical terminal applicators and, particularly, to an improved adjusting means for a track which guides tapes with terminals secured thereto.

BACKGROUND OF THE INVENTION

It now is commonly known in the art of crimped electrical terminals to provide many types of crimpable terminals on a continuous carrier strip of thin metal material from which the terminals are formed. The terminal strip usually is fed off of a reel. The terminals can thereby be fed to a crimping apparatus, and the leading terminal of the strip is crimped onto a wire. The present invention relates to an improved applicator for crimping electrical terminals on such a strip and particularly to an improved adjusting means for a track which guides the terminal strip.

A known type of electrical terminal applicator includes an applicator ram drivable by a press ram through a working stroke towards, and a return stroke away from, a crimping anvil. The applicator ram has a first crimping die for cooperation with the anvil to crimp a first portion of an electrical terminal onto an exposed end of a conductive core of an insulated electrical wire during each working stroke of the applicator ram. The applicator ram has a second crimping die for cooperation with the anvil to crimp a second portion of the terminal onto the insulation of the electrical wire during each working stroke of the applicator ram. The second crimping die is adjustable axially of the applicator ram. Plate means are mounted for angular adjustment about an axis on, and extending lengthwise of, the applicator ram. The plate means selectively interpose first projections between the press ram and the applicator ram to adjust the shut height of the first and second dies, and selectively interpose second projections between the applicator ram and the second crimping die to independently adjust the shut height of the second die.

In this known terminal applicator, as well as other similar strip-feeding applicators, the applicator ram can be considered as being drivable in a first path through its working stroke, and the terminal strip is fed in a second path which intersects the first path of the applicator ram. Strip feeding means are provided for indexing the strip along the second path to sequentially advance a leading uncrimped terminal on the strip in response to reciprocation of the ram. Typically, a track guides the strip along the second path toward the reciprocating ram. It is common to provide some form of adjusting means for adjusting at least a portion of the track transverse of the second path to accommodate different sizes of strips and/or terminals or simply to adjust the position of the strip transversely of the second path to ensure proper and accurate crimping of the terminals by the crimping dies.

Heretofore, one form of adjusting means has included an adjusting screw extending through an adjustable portion of the track in a direction transverse to the second path in which the terminal strip is fed. A head of the adjusting screw is exposed at a front face of the adjustable track portion for access by an appropriate tool for rotating the adjusting screw. A locking means is provided for locking the adjusting screw in any position of adjustment. Heretofore, the locking means has been provided in the form of a second, locking screw extending upwardly from the bottom of the track for either locking the adjustable track portion or to prevent any further rotation of the adjusting screw. However, a problem with such a system is that the entire applicator head must be removed to gain access to the bottom-adjustable locking screw. This is a very time consuming, labor intensive system simply to afford a means to lock the adjustable track portion in position. The problem is magnified with the ever-increasing trend toward miniaturized terminals which can require repeated adjustments of the guide track even during any given manufacturing run of a particular small terminal size.

The present invention is directed to solving these problems by providing a track adjusting means which is extremely simple and provides both adjustment of the track as well as locking the track from the front of the applicator head.

SUMMARY OF THE INVENTION

An object, therefore, of the invention is to provide an electrical terminal applicator of the character described, with an improved adjusting means for an adjustable track portion of the applicator.

In the exemplary embodiment of the invention, an electrical terminal applicator is provided for crimping terminals onto wires, with the terminals being secured on a strip in a side-by-side relationship. An applicator ram is drivable in a first path through a working stroke towards, and a return stroke away from, a crimping anvil. A crimping die on the applicator ram cooperates with the anvil to crimp a portion of a terminal onto a wire during each working stroke of the ram. Track means are provided for guiding the strip in a second path which intersects the first path of the ram and includes a track portion mounted for adjustable movement in a direction transverse to the second path. An adjusting screw is threaded into a transverse hole in the movable track portion for adjusting the position of the track portion in the direction transverse to the second path. A locking set screw is threaded into the transverse hole for jamming against an end of the adjusting screw to lock the adjusting screw and, thus, the track portion in any position of adjustment.

Preferably, the adjustable track portion includes a front face. The locking set screw, in its loaded condition, preferably is located substantially entirely within the transverse hole inwardly of the front face of the adjustable track portion. This places both the adjusting screw and the locking set screw interiorly of the track so that they do not interfere with any other moving parts of the terminal applicator.

Mounting means are provided for freely rotatably mounting the adjusting screw on the applicator and fixing the adjusting screw against axial movement thereof. In the exemplary embodiment of the invention, the mounting means includes a fixed mounting block freely rotatably receiving and axially capturing an enlarged head portion of the adjusting screw.

The end of the adjusting screw includes a tool-engaging means for engagement by an appropriate tool to adjustable rotate the adjusting screw. As disclosed herein, the tool-engaging means is provided by a slot for receiving a screw-driver type tool. The locking set screw is generally hollow for insertion therethrough of the tool for engaging the slot on the end of the adjusting screw. The generally hollow locking set screw includes internal tool-engaging means for receiving an appropriate tool, such as an Allen wrench, to rotate the set screw.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
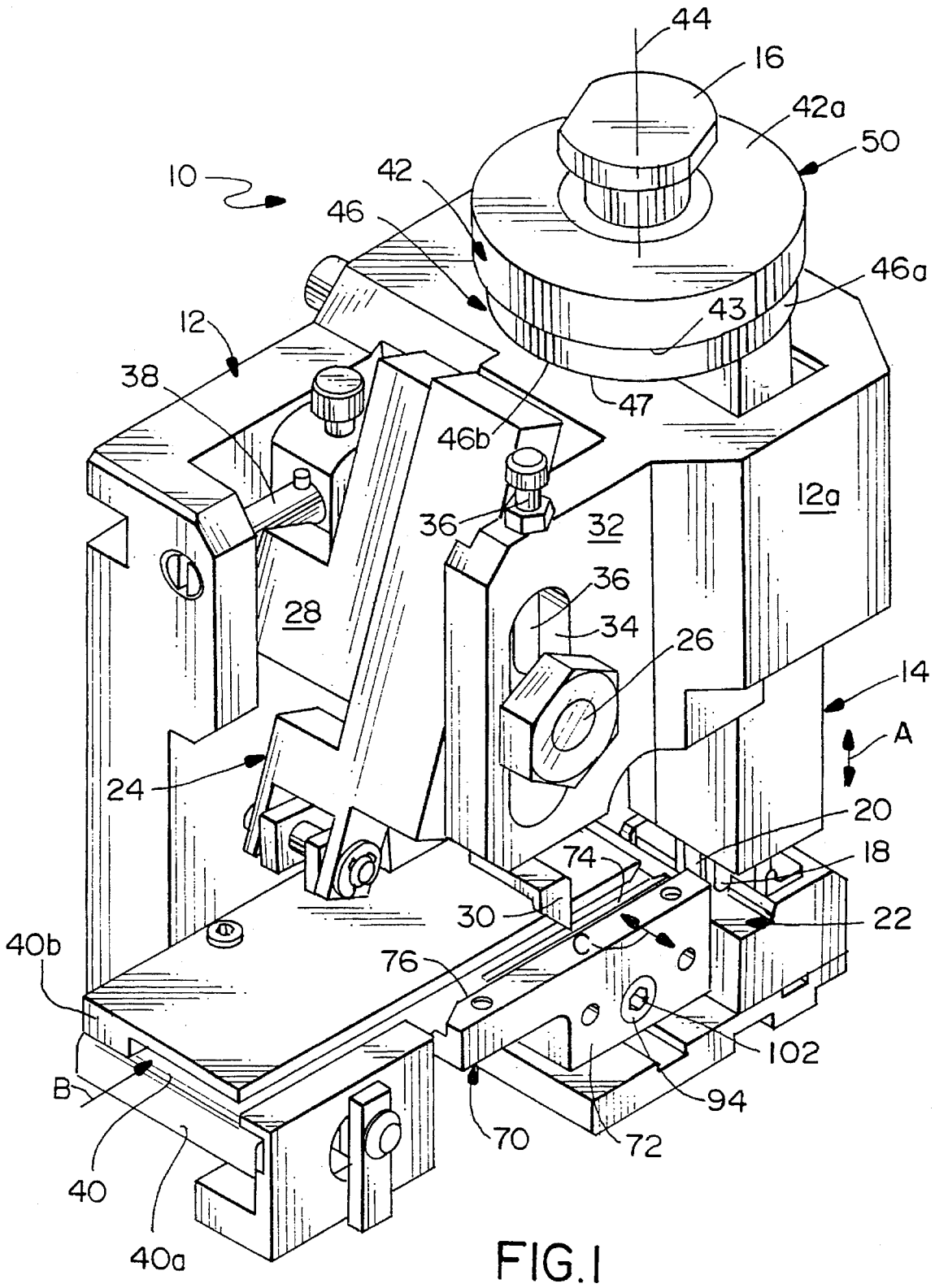
FIG. 1 is a perspective view of a portion of an applicator for crimping electrical terminals to stripped end portions of insulated electrical wires, the applicator including the track adjusting means of the invention.

Referring to the drawings in greater detail, and first to FIG. 1, an electrical terminal applicator, generally designated 10, includes a frame, generally designated 12, which, in turn, includes an applicator ram housing 12*a* in which is mounted an applicator ram, generally designated 14, for vertical reciprocating motion within the housing in the direction of double-headed arrow "A". An adaptor head 16 projects upwardly of applicator ram 14 for engagement by a press ram (not shown). An insulation crimping die 18 projects from the bottom of applicator ram 14, beneath housing 12*a*, and is juxtaposed with a conductive core crimping die 20 also projecting from the applicator ram beneath housing 12*a*. Die 18 is positioned forwardly of die 20 when viewed in FIG. 1. A crimping anvil means, generally designated 22, is located on frame 12 beneath crimping dies 18 and 20.

In the general operation of applicator 10, applicator ram 14 is drivable by means of the press ram through a working stroke towards, and a return stroke away from, crimping anvil means 22, as indicated by double-headed arrow "A". First or rear crimping die 20 cooperates with anvil means 22 to crimp a first portion of an electrical terminal onto an exposed end of a conductive core of an insulative electrical wire during each downward working stroke of applicator ram 14. Second or front crimping die 18 cooperates with anvil means (not shown) to crimp a second portion of the terminal onto the insulation of the electrical wire during each downward working stroke of the applicator ram.

Still referring to FIG. 1, a terminal strip feed assembly, generally designated 24, is secured between frame 12 and housing 12*a* and includes a pivot pin 26, a rocker arm 28 and a feed finger 30 which is loaded by return spring (not shown). The return spring is behind a brace portion 32 of housing 12*a* and is provided by a torsion coil spring about pin 26. The pivot pin is adjustable lengthwise of a slot 34 in brace 32 to determine the end positions of feed finger 30. In other words, adjustment of the location of the pivot point defined by pin 26 adjusts the length of the stroke of feed finger 30. The pivot pin is adjustable by means of a screw 36. Rocker arm 28 is swung about pivot pin 26 by means of a slidable rod 38 (by means not shown) to feed a strip of terminals along a track 40 in the direction of arrow "B" toward anvil means 22 to located the leading terminal of the strip on the anvil. The track 40 is defined between a lower track member 40*a* and an upper track member 40*b*. As the press ram drives applicator ram 14 downwardly as described above, crimping dies 18 and 20 are effective to crimp the lead terminal onto the stripped end of the insulated electrical wire. The press ram/applicator ram are cycled in unison with the operation of rocker arm 28 and feed finger 30 to incrementally advance terminals from the strip thereof to the crimping station defined by anvil means 22 and crimping dies 18 and 20. The applicator ram can be considered as being drivable in a first path through its working stroke generally in the direction of arrow "A", and the terminal strip is fed in a second path indicated by arrow "B" which intersects the first path of the applicator ram.

Generally, a plurality of adjusting plate means are provided for adjusting the shut heights of the crimping die 18 and/or crimping die 20. Specifically, a first adjusting plate means, generally designated 42, is mounted for angular adjustment about an axis 44 on and extending in the direction of movement of applicator ram 14. The first adjusting plate means includes a relatively massive cast circular plate 42*a* having a bottom, concentric ramped surface 43 for purposes of adjusting the shut height of crimping die 18.

A second adjusting plate means, generally designated 46, is mounted for angular adjustment about axis 44. The second adjusting plate means includes a cast circular plate 46*a* having a bottom, concentric ramped surface 47 for adjusting the shut height of crimping die 20.

The invention herein is directed to an improved track adjusting means for adjusting the position of the terminal strip transverse to its feeding path of travel as indicated by arrow "B" in FIG. 1. More particularly, referring to FIG. 2 in conjunction with FIG. 1, an adjustable track portion, generally designated 70, substantially underlies track 40 and includes a front face 72. Track portion 70 includes a slot 74 for accommodating the stroke of reciprocating feed finger 30 and an upstanding shoulder 76 against which a front edge of the terminal strip rides as the strip is fed to the crimping dies of the applicator in the direction of arrow "B". Generally, the improved adjusting means is effective to adjust track portion 70 in the direction of double-headed arrow "C". It should be understood that the invention is applicable in applicators which feed terminals on a continuous strip or tape of thin material such as plastic.

Figure 2:
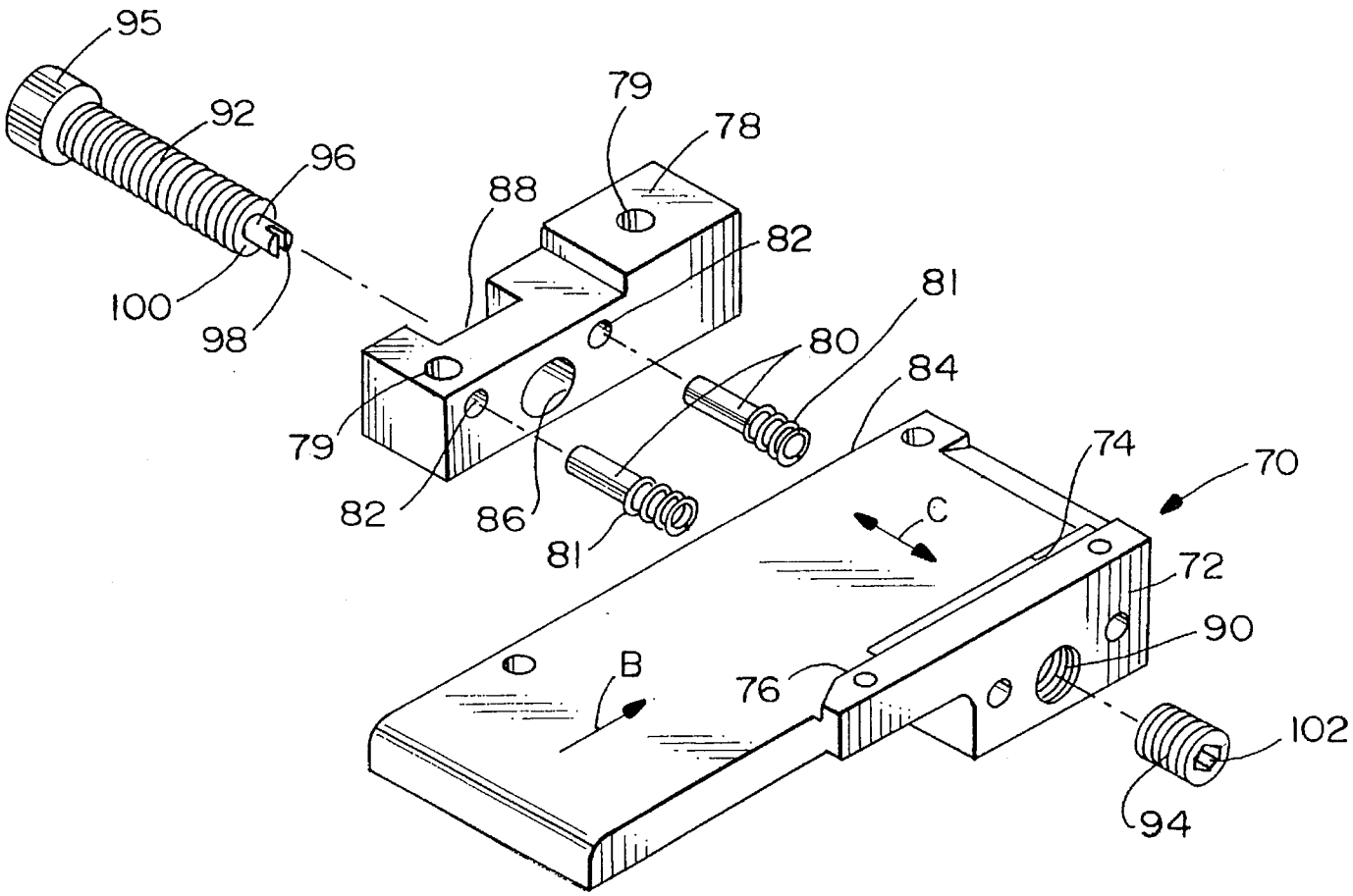
FIG. 2 is an exploded perspective view of the adjusting means in conjunction with an adjustable portion of the track.
Figure 3:
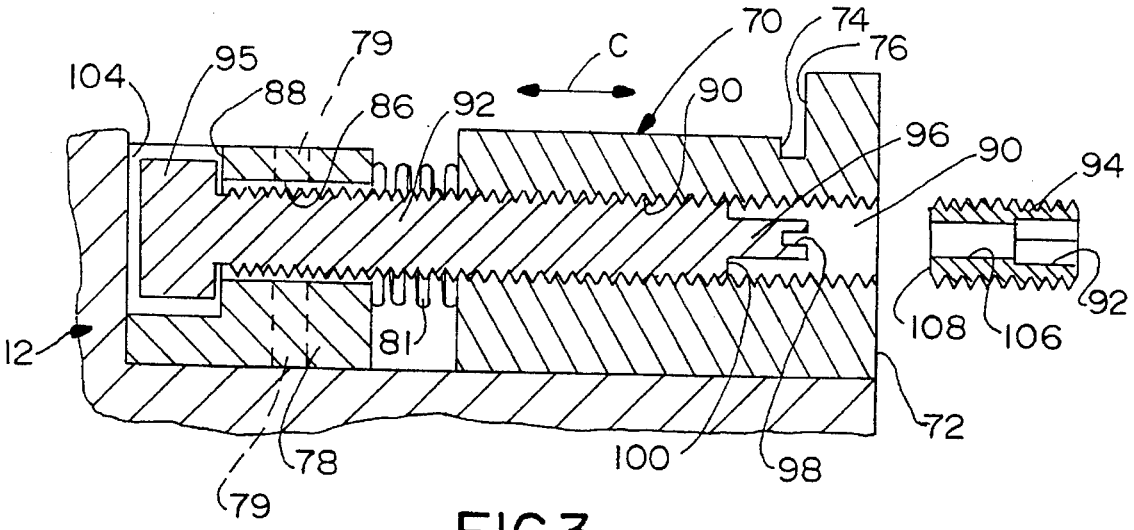
FIG. 3 is a vertical section through the adjusting means and adjustable track portion, with the locking set screw removed.
Figure 4:
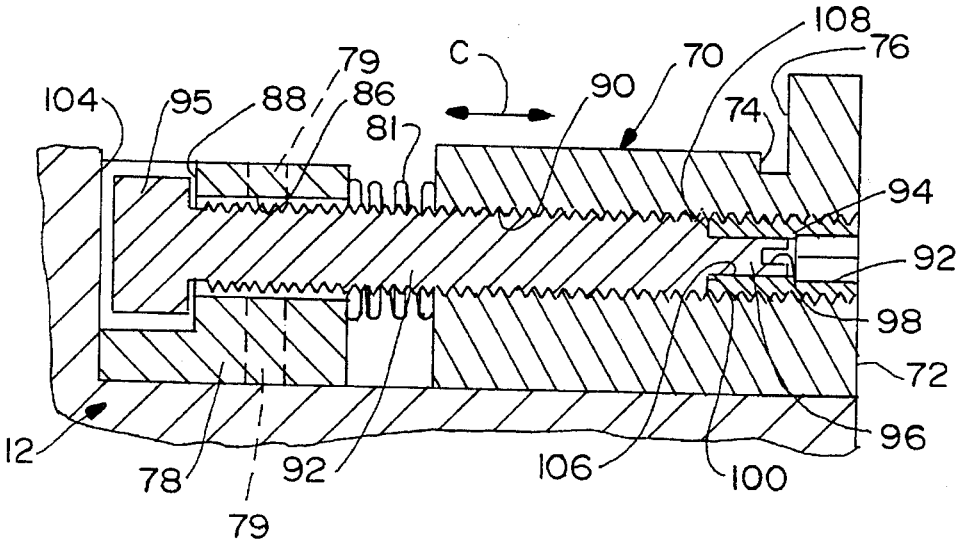
FIG. 4 is a view similar to that of FIG. 3, with the locking set screw in its locking condition.

Specifically, FIG. 2 shows a mounting block 78 which is appropriately fixed within the applicator ram behind track 40 and adjustable track portion 70, such as by appropriate fasteners extending through holes 79 and into frame 12 as seen in FIGS. 3 and 4. A pair of guide rods 80 are fixed within apertures 82 of the mounting block and freely into holes in a back face 84 of track portion 70 to guide the track portion in its range of adjustment in the direction of double-headed arrow "C". A compression spring 81 is positioned around each guide rod 80 to bias adjustable track portion 70 away from fixed mounting block 78. These spring ensured that adjustable track portion 70 will remain in the .same position before and after tightening the locking set screw 94 described below. The mounting block further includes a through hole 86 communicating with a back recess 88. An internally threaded hole 90 is formed in adjustable track portion 70 in axial alignment with through hole 86 in mounting block 78.

Basically, the simple and effective adjusting means of the invention includes an adjusting screw 92 and a locking set screw 94. As clearly seen in FIG. 2, adjusting screw 92 is externally threaded and includes an enlarged rear head portion 95 and a forwardly protruding, reduced diameter boss portion 96. The boss portion includes a tool-engaging means in the form of a slot 98. With the boss portion being of a reduced diameter, a circular shoulder or face 100 is formed near the front end of adjusting screw 92 about boss portion 96.

Locking set screw 94 also is externally threaded as clearly seen in FIG. 2. It can be seen that the front of the set screw has a hexagonal socket 102 for receiving an appropriate tool, such as an Allen wrench, for rotating the set screw.

Referring to FIG. 3 in conjunction with FIG. 2, it can be seen that adjusting screw 92 is freely rotatable within through hole 86 in mounting block 78, but the adjusting screw is threaded into transverse hole 90 in adjustable track portion 70. The enlarged head portion 95 of the adjusting screw is received within back recess 88 at the rear of the mounting block to capture the head portion within the recess and a wall 104 of the applicator frame 12. Therefore, the adjusting screw is free to rotate relative to mounting block 78, but the adjusting screw is fixed against axial movement relative to the mounting block and the applicator as a whole. Consequently, when the adjusting screw is rotated within internally threaded hole 90 of adjustable track portion 70, the track portion is adjustable movable in the direction of double-headed arrow "C". This adjustment can be effected by inserting a tool, such as a common screw-driver, into the front end of hole 90, into slot 98 of the adjusting screw and simply rotating the screw. It can be seen in FIG. 3 that the front end of the adjusting screw is located entirely interiorly of transverse hole 90 within the adjustable track portion 70.

It can be seen in FIGS. 3 and 4 that locking set screw 94 not only includes a front tool-receiving socket 92, but the entire set screw is generally hollow, as at 106, so that the screw-driver can be inserted entirely therethrough for engagement within slot 98 at the front end of adjusting screw 92. Therefore, the locking set screw does not have to be completely removed from hole 90 in order to allow rotational adjustment of adjusting screw 92. The locking set screw simply must be rotatably loosened to allow rotation of the adjusting screw.

In order to lock adjusting screw 92 against rotation and, thus, effectively fix the position of adjustable track portion 70, locking set screw 94 is rotated inwardly until a rear face 108 of the set screw abuts face 100 of the adjusting screw. When these opposing faces are tightly engaged, the locking set screw jams the adjusting screw against any further rotation and effectively locks the adjustable track portion in any given transverse position of adjustment.

FIG. 4 shows that, when locked, both the adjusting screw and the locking set screw are located entirely within transverse hole 90 in adjustable track portion 70. In other words, the locking set screw is located inwardly of front face 72 of the track portion. Therefore, no part of the adjusting means of the invention projects outwardly of the track means of the applicator which might interfere with any other components of the machine. FIG. 4 shows an inner-most position of the adjustable track portion. If the track portion is adjusted further outward or forward of the applicator, the locking set screw would be located further inwardly of hole 90 than is shown in FIG. 4. In any event, it is contemplated that the locking set screw not project forwardly of the adjustable track portion to any significant extent if it is desired to have a flush front face of the track portion.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical terminal applicator for crimping terminals onto wires, with the terminals being secured on a strip in a side-by-side relationship, comprising:

an applicator ram drivable in a first path through a working stroke towards, and a return stroke away from, a crimping anvil;

a crimping die for cooperation with the anvil to crimp a portion of a terminal onto a wire during each working stroke of the ram;

track means for guiding the strip in a second path which intersects the first path of the ram and including a track portion mounted for adjustable movement in a direction transverse to the second path;

an adjusting screw threaded into a transverse hole in the movable track portion for adjusting the position of the track portion in said direction transverse to the second path;

a locking set screw threaded into said transverse hole for jamming against an end of the adjusting screw to lock the adjusting screw and, thus, the track portion in a predetermined position of adjustment; and said end of the adjusting screw includes a tool-engaging means for engagement by an appropriate tool to adjustably rotate the adjusting screw and said locking set screw is generally hollow for insertion therethrough of the tool for engaging the tool-engaging means on the end of the adjusting screw.

2. The electrical terminal applicator of claim 1 wherein said track portion includes a front face, and said locking set screw in its locking condition is located substantially entirely within the transverse hole inwardly of the front face of the track portion.

3. The electrical terminal applicator of claim 1, including mounting means for freely rotatably mounting the adjusting screw on the applicator and fixing the adjusting screw against axial movement thereof.

4. The electrical terminal applicator of claim 3 wherein said mounting means comprises a fixed mounting block freely rotatably receiving and axially capturing an enlarged head portion of the adjusting screw.

5. The electrical terminal applicator of claim 1 wherein said tool-engaging means comprises a slot for receiving a tool having a blade-like structure.

6. The electrical terminal applicator of claim 5 wherein said generally hollow locking set screw includes internal tool-engaging means for receiving an appropriate tool to rotate the set screw.

7. The electrical terminal applicator of claim 1 wherein said generally hollow locking set screw includes internal tool-engaging means for receiving an appropriate tool to rotate the set screw.

8. An electrical terminal applicator for crimping terminals onto wires, with the terminals being secured on a strip in a side-by-side relationship, comprising:

an applicator ram drivable in a first path through a working stroke towards, and a return stroke away from, a crimping anvil;

a crimping die for cooperation with the anvil to crimp a portion of a terminal onto a wire during each working stroke of the ram;

track means for guiding the strip in a second path which intersects the first path of the ram and including a track portion mounted for adjustable movement in a direction transverse to the second path, the track portion including a front face;

an adjusting screw threaded into a transverse hole in the movable track portion for adjusting the position of the track portion in said direction transverse to the second path;

a locking set screw threaded into said transverse hole for jamming against an end of the adjusting screw to lock the adjusting screw and, thus, the track portion in a predetermined position of adjustment, said locking set screw in its locking condition being located substantially entirely within the transverse hole inwardly of the front face of the track portion;

mounting means for freely rotatably mounting the adjusting screw on the applicator and fixing the adjusting screw against axial movement thereof;

a tool-engaging means on said end of the adjusting screw for engagement by an appropriate tool to adjustably rotate the adjusting screw, said tool-engaging means comprising a slot for receiving a tool having a blade-like structure; and said locking set screw being generally hollow for insertion therethrough of the tool for engaging the tool-engaging means on the end of the adjusting screw.

9. The electrical terminal applicator of claim 8 wherein said mounting means comprises a fixed mounting block freely rotatably receiving and axially capturing an enlarged head portion of the adjusting screw.

10. The electrical terminal applicator of claim 8 wherein said generally hollow locking set screw includes internal tool-engaging means receiving an appropriate tool to rotate the set screw.

11. An electrical terminal applicator for crimping terminals onto wires, with the terminals being secured on a strip in a side-by-side relationship, comprising:

an applicator ram drivable in a first path through a working stroke towards, and a return stroke away from, a crimping anvil;

a crimping die for cooperation with the anvil to crimp a portion of a terminal onto a wire during each working stroke of the ram;

track means for guiding the strip in a second path which intersects the first path of the ram and including a track portion mounted for adjustable movement in a direction transverse to the second path;

an adjusting screw threaded into a transverse hole in the movable track portion for adjusting the position of the track portion in said direction transverse to the second path;

a locking set screw threaded into said transverse hole for jamming against an end of the adjusting screw to lock the adjusting screw and, thus, the track portion in a predetermined position of adjustment; and mounting means for freely rotatably mounting the adjusting screw on the applicator and fixing the adjusting screw against axial movement thereof, said mounting means comprising a fixed mounting block freely rotatably receiving and axially capturing an enlarged head portion of the adjusting screw.

12. The electrical terminal applicator of claim 11 wherein said track portion includes a front face, and said locking set screw in its locking condition is located substantially entirely within the transverse hole inwardly of the front face of the track portion.

13. The electrical terminal applicator of claim 11 wherein said end of the adjusting screw includes a tool-engaging means for engagement by an appropriate tool to adjustable rotate the adjusting screw.

14. The electrical terminal applicator of claim 13 wherein said tool-engaging means comprises a slot for receiving a tool having a blade-like structure.

15. The electrical terminal applicator of claim 13 wherein said locking set screw is generally hollow for insertion therethrough of the tool for engaging the tool-engaging means on the end of the adjusting screw.

16. The electrical terminal applicator of claim 15 wherein said generally hollow locking set screw includes internal tool-engaging means for receiving an appropriate tool to rotate the set screw.

* * * * *